United States Patent [19]

Sowards

[11] Patent Number: 4,477,083

[45] Date of Patent: Oct. 16, 1984

[54] SPORTS TRAINING AND PRACTICE DEVICE

[76] Inventor: Gregory E. Sowards, 1415 S. Maple, Carthage, Mo. 64836

[21] Appl. No.: 518,639

[22] Filed: Jul. 29, 1983

[51] Int. Cl.[3] ..... A63B 71/02

[52] U.S. Cl. ..... 273/411; 272/65; 273/58 C; 273/319

[58] Field of Search ..... 273/411, 58 C, 342, 273/397, 319, 331, 333, 334, 335; 272/65, 76, 77, 78

[56] References Cited

U.S. PATENT DOCUMENTS

| | | | |
|---|---|---|---|
| Re. 30,344 | 7/1980 | McNeil | 272/65 |
| 925,342 | 6/1909 | Johnson | 272/78 |
| 2,435,864 | 2/1948 | Adams | 272/78 |
| 3,256,021 | 6/1966 | Nissen et al. | 273/411 X |
| 3,498,613 | 3/1970 | Dreyer | 273/58 C X |

*Primary Examiner*—William H. Grieb

*Attorney, Agent, or Firm*—Rogers, Eilers & Howell

[57] ABSTRACT

A sports training and practice device that comprises a trampoline having a resilient surface forming a playing surface, an arm extending from the trampoline, and a ball-like bag resiliently mounted to the outer end of the arm. The inner end of the arm has a collar for installation over one of the legs of the trampoline, and permits relative sliding and rotational motion therebetween. The collar and arm are slid and rotated on the leg until the bag is at the desired height and distance relative to the playing surface, and the collar is engaged to the leg at that point by tightening a bolt threaded through the collar to impinge on the leg. The bag and arm may be separately provided for addition to existing trampolines.

18 Claims, 5 Drawing Figures

FIG. 3.
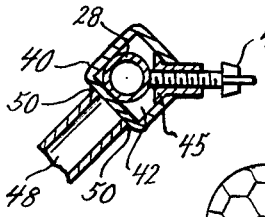
FIG. 1.
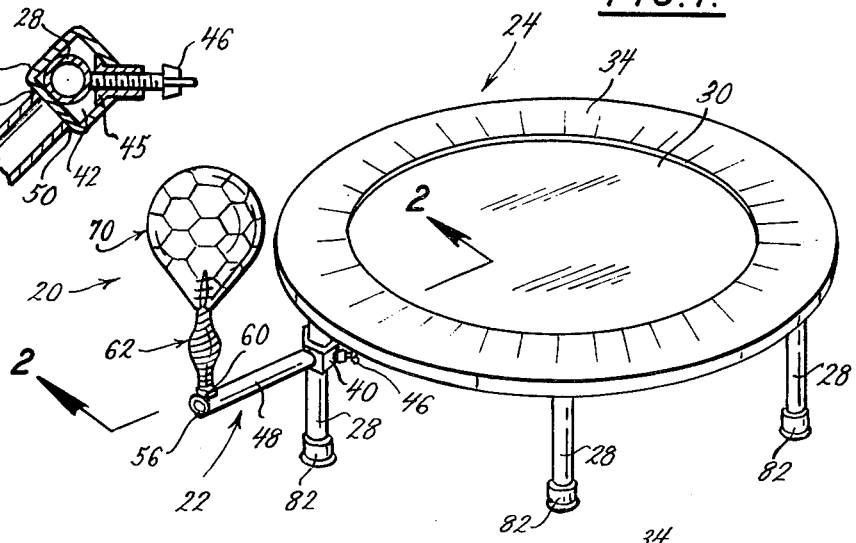
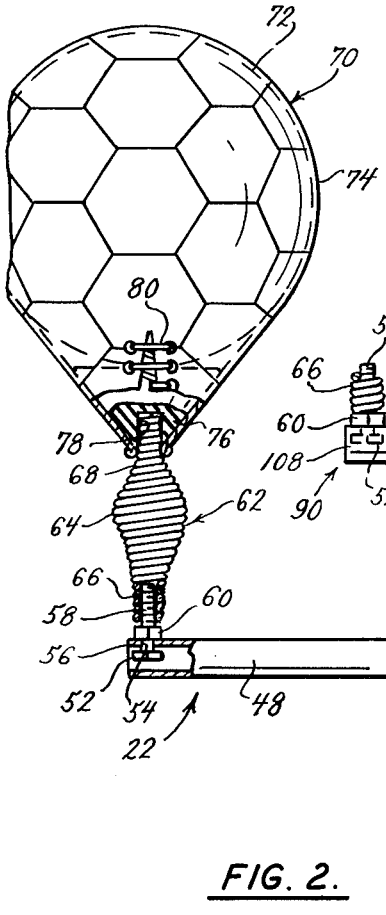
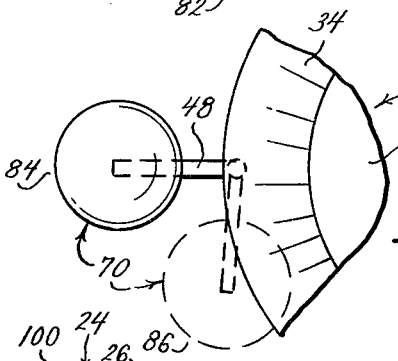
FIG. 4.
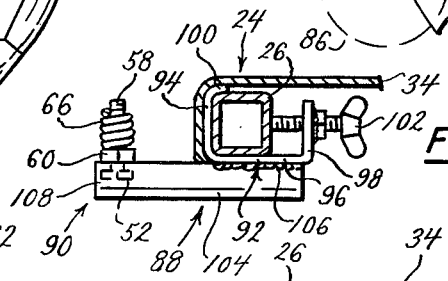
FIG. 5.
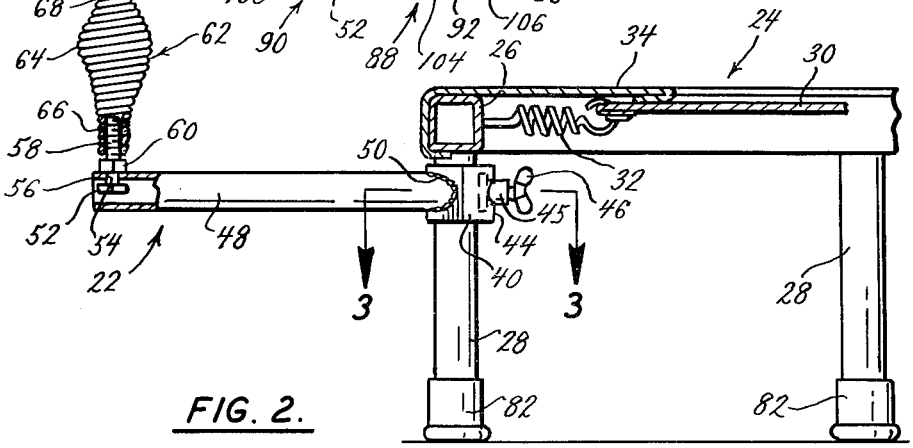
FIG. 2.

SPORTS TRAINING AND PRACTICE DEVICE

BACKGROUND AND SUMMARY OF THE INVENTION

This invention relates to an athletic training device and in particular to a device to develop and maintain the skills important to the play of soccer.

One prior art device for soccer training or practice involved tethering a soccer ball to an anchor in the ground with a length of elastic cord. Such devices presented numerous problems and consequently were of limited utility. The soccer ball and cord apparatus required a large flat area, which limited possible sites and virtually precluded indoor use. The tethering cord had to be securely anchored to the ground. This was typically accomplished by driving an anchoring pin into the ground. This damaged the ground and was unuseable on hard surfaces such as asphalt or cement or indoors. Also, the anchoring device or the cord could cause the user to trip. Finally, the elastic cord tether caused a fixed and slow return time that did not adequately prepare the user for real soccer play. The slowness of the tether system simply did not permit the user to develop the quickness and co-ordination crucial to the game.

Another prior art device was a resilient panel or backstop arranged vertically or at a near vertical angle against which the user kicked the ball. This device, too, suffered from numerous problems and consequently was of limited usefulness. Like the soccer ball and cord apparatus, the backstop device required a large flat area which restricted possible sites and virtually precluded indoor use. Since the ball was not tethered or otherwise contained, use was further limited to areas where an escaped ball could cause no damage. Yet another problem was the cumbersome support mechanism on the device, which was prone to collapse. Finally, like the soccer ball and cord apparatus, the backstop device provided a slow return time that did not adequately prepare the user for real soccer play. The slowness of the backstop device simply did not permit the user to develop the quickness and co-ordination crucial to the game.

An example of an excellent training and practice device is the device disclosed in my copending application Ser. No. 472,072 filed Mar. 4, 1983. That device comprises a ball rebounder in communication with a playing surface formed by a trampoline. Resilient cords, supported by collapsible safety poles about the periphery of the trampoline, enclose the playing surface. The user positions himself on the playing surface, which allows him to simulate running, jogging, or standing, and kicks the ball into the rebounder, which returns it to him. Escaped balls are contained on the playing surface by the resilient cords.

The rebounder device just described was a vast improvement over the prior art, and my present invention is not intended to supplant it but to complement it by providing an alternative soccer training and practice device concentrating on the development of quickness and co-ordination. My present invention supplements my prior rebounder device in a soccer training regimen in much the same way that a punching bag supplements other facets of a boxer's training.

The training and practice device of my present invention comprises a ball resiliently mounted on an arm extending from the frame of a trampoline. The trampoline provides a playing surface on which the user positions himself and allows the user to simulate running, jogging, or standing.

In the first embodiment a collar encircles one of the legs of the trampoline and is engaged thereto by a butterfly bolt. An arm extends from the collar generally radially from the trampoline. A ball-like bag is resiliently mounted to the top of the arm near the free end. The height of the ball with respect to the playing surface is adjustable by raising or lowering the collar on the leg of the trampoline. The distance of the ball from the playing surface is adjustable by rotating the collar on the leg of the trampoline, so that the orientation of the arm becomes less radial and more tangential to the trampoline, thereby reducing the distance, or more radial and less tangential to the trampoline, thereby increasing the distance.

In the second embodiment, a bracket engages the frame of the trampoline and is secured thereto by a butterfly bolt threaded through one portion of the bracket and engaging the frame against another portion of the bracket. A relatively short arm is attached to the bracket and extends generally outwardly from the playing surface. A ball-like bag is resiliently mounted to the top of the arm near the free end.

The device of this invention provides valuable training and practice of the skills required to play soccer, yet it is of simple and inexpensive construction. In the first embodiment of this invention the height and distance of the ball from the playing surface is adjustable so the one device can accommodate all users. Although both embodiments permit the user to simulate running, jogging, or standing while training, they can be used virtually anywhere, indoors or outside, since only a minimal flat surface is required. And either embodiment can be easily retro-fit to an existing trampoline and once attached does not impair the operation or use of the trampoline. The whole apparatus is relatively light weight and is easily transported or stored.

BRIEF DESCRIPTION OF THE DRAWINGS

FIG. 1 is a perspective view of the first embodiment of a training and practice device showing the bag support mechanism mounted on the trampoline;

FIG. 2 is a side view of the bag support mechanism taken along line 2—2 in FIG. 1, showing its mounting to the trampoline;

FIG. 3 is a partial cross-sectional view of the bag support mechanism taken along line 3—3 in FIG. 2, detailing its mounting to the trampoline;

FIG. 4 is a partial top view of the device showing the adjustment of the distance of the ball from the trampoline; and, FIG. 5 is a is a side view of the second embodiment of a training and practice device showing the bag support mechanism mounted on the trampoline.

DESCRIPTION OF THE PREFERRED EMBODIMENTS

The first embodiment 20 of the training and practice device of this invention, as shown in FIGS. 1 and 2, comprises a bag support mechanism 22 and trampoline 24. Trampoline 24, as is generally known in the art, comprises frame 26 supported by a plurality of legs 28, a playing surface 30 resiliently supported from frame 26 by a plurality of springs 32, and an apron 34 covering frame 26 and springs 32. Particularly suited to this invention are the round mini-trampolines known in the art.

Bag support mechanism 22 comprises a collar 40 having an aperture 42 for receiving a leg 28 of trampoline 24. It is preferable that collar 40 have a quadrilateral cross section although any other suitable configuration can be used, for example, circular. A hole (not shown) is provided in corner 44 of collar 40, oriented generally perpendicular to aperture 42. A T-nut fastener 45 is disposed in the hole in the collar with its shoulder abutting the inside of the collar and the stem extending outwardly through the hole. A butterfly bolt 46, threaded into the T-nut fastener 45 in the collar 40, can be tightened to impinge on leg 28, and engage leg 28 between bolt 46 and the two faces of collar 40 opposite bolt 46. An arm 48, which can be made of tubular steel, is attached to one of the two faces of collar 40 opposite to bolt 46, as by welds 50.

A bolt 52 is located in hole 54 in the top of the free end 56 of arm 48, with its threaded portion 58 extending upward. Bolt 52 is secured in hole 54 by nut 60 on the top of arm 48, with a significant section of the threaded portion 58 extending upwardly beyond nut 60. A coil spring 62, preferably of the type having a bulbous midsection 64 and a tapering bottom 66 and top 68, is mounted on bolt 52. Bottom 66 of spring 62 is fitted over threaded portion 58 of bolt 52, the lower coils of spring 62 effecting a tight engagement of bolt 52.

The top 68 of spring 62 is attached to a bag 70, which is similar to a punching bag. These bags are known in the art. As shown in FIG. 2, a ball shaped airfilled rubber bladder 72 is disposed in the bulb of a teardrop shaped cover 74. A rubber cone 76 having an axial bore 78 is provided in the neck of the teardrop shaped cover 74. Laces 80 secure cover 74, holding bladder 72 and cone 76 in abutment. Top 68 of spring 62 is received in bore 78 of rubber cone 76.

An alternative method of resiliently mounting bag 70 is to use a bag structure similar to that just described, except that rubber cone 76 is provided with a downward extension or foot which protrudes through the bottom of the teardrop shaped cover. This foot can then be mounted directly to the top of arm 48, to resiliently support bag 70 without the need for spring 62.

Bag support mechanism 22 is quickly and easily mounted to trampoline 24 by removing cap 82 on a leg 28 of trampoline 24 and sliding collar 40 over leg 28, and replacing cap 82. Bag 70 is then adjusted to the proper position. The height of bag 70 can be adjusted by raising or lowering collar 40 on leg 28. The distance between bag 70 and playing surface 30 can be adjusted by rotating collar 40 and arm 48 between the position where arm 48 extends radially from trampoline 24 (bag 70 is furthest from playing surface 30) and the position where arm 48 extends tangentially from trampoline 24 (bag 74 is closest to playing surface 30). This feature is best shown in FIG. 4 where in position 84 arm 48 extends radially from trampoline 24 and bag 70 is far from playing surface 30. By turning collar 40 and arm 48 counter-clockwise to position 86, shown in dashed lines, arm 48 extends tangentially from trampoline 24 and bag 70 is close to playing surface 30. After selecting the most comfortable position for bag 70, butterfly bolt 46 is hand tightened to fix the position.

FIG. 5 is a partial view of the second embodiment 88 of the training and practice device of this invention. Like the first embodiment, the second embodiment 88 comprises a trampoline 24, as described above, of which only frame 26 and apron 34 are shown in FIG. 5. Second embodiment 88 also comprises a bag support mechanism 90. Mechanism 90 has bracket 92 comprising front 94, bottom 96, and back 98. A lip 100 extends rearwardly from the top of front 94. Bracket 92 engages the frame 26 of trampoline 24 between lip 100, front 94 and bottom 96. Butterfly bolt 102, threaded through a hole in back 98 of bracket 92 can be tightened to secure frame 26 against bracket 92.

Arm 104 is attached to the bottom 96 of bracket 92 as by welds 106. Arm 104 extends outwardly, and free end 108 is provided with a resiliently mounted bag 70. This mounting is accomplished in the manner described above with regard to the first embodiment.

Bag support mechanism 90 is quickly and easily mounted to trampoline 24 by lifting apron 34 and engaging bracket 92 over frame 26. Bracket 92 is secured by tightening bolt 102 in the back of bracket 92 to urge frame 26 against front 94 of bracket 92.

With the bag support mechanism of either embodiment properly mounted to the trampoline, the user then positions himself on playing surface 30 where he can simply stand or can jog or run in place. The user than kicks bag 70. Each kick deflects bag 70 from its normally vertical position, but spring 62 restores it. The user then tries to develop a rhythm, eventually trying to co-ordinate stepping and kicking.

In either embodiment, bag 70 and spring 62 are detached from bolt 52 for repair or replacement, or simply to facilitate storage. Of course the whole device can be quickly and easily removed. In the first embodiment this is accomplished by removing cap 82 on leg 28, loosening bolt 46, sliding collar 40 off leg 28, and replacing cap 82; in the second embodiment this is accomplished by loosening bolt 102 and pulling bracket 92 from engagement with frame 26, and replacing apron 34. However, such removal should not be necessary because the device does not impair or impede any other use of the trampoline.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. A sports training and practice device comprising:
   a trampoline having a resilient surface forming a playing surface;
   an arm;
   means for mounting one end of said arm to the trampoline so that the other end thereof extends generally outwardly from the trampoline;
   a bag; and,
   means for mounting the bag upright on the arm in a position where it can be kicked by a player located on the playing surface.

2. The device of claim 1 further comprising means for selectively adjusting the height of the bag relative to the playing surface.

3. The device of claim 2 wherein the means for selectively adjusting the height of the bag comprises means for adjusting the height of the arm relative to the playing surface.

4. The device of claim 1 further comprising means for selectively adjusting the distance between the bag and the playing surface, said distance adjusting means including means to adjust the angle of the arm with respect to the perimeter of the trampoline.

5. A sports training and practice device adapted for mounting to a trampoline, the trampoline having a resilient surface acting as a playing surface on a frame supported by a plurality of legs, said device comprising:

an arm, said arm having an inner end and an outer end;

means for mounting the inner end of the arm to one of the legs of the trampoline so that the arm extends generally outwardly from the trampoline;

a bag, and, means for resiliently mounting the bag upright on the arm in a position where it can be kicked by a player located on the playing surface.

6. The device of claim 5 wherein the means for mounting the arm to the trampoline comprises:

a bracket attached to the inner end of the arm for mating with one of the legs of the trampoline along its height; and, means for engaging the bracket to the leg of the trampoline at a preselected height therealong so that the height of the bag mounted to the arm with respect to the playing surface is adjustable by raising or lowering the bracket on the leg and engaging the bracket to the leg at the desired height.

7. The device of claim 5 wherein the means for mounting the arm to the trampoline comprises:

a bracket attached to the inner end of the arm for mating with one of the legs of the trampoline about the leg's periphery; and, means for engaging the bracket to the leg of the trampoline at a preselected point about the leg's periphery so that the direct distance between the bag on the arm and the playing surface is adjustable by rotating the bracket and arm about the leg and engaging the bracket to the leg at the desired point.

8. The device of claim 5 wherein the means for mounting the arm to the trampoline comprises:

a collar attached to the inner end of the arm, said collar having an aperture for receiving one of the legs of the trampoline and permitting relative vertical sliding motion therebetween; and, means for engaging the collar to the leg at a preselected height therealong so that the height of the bag mounted to the arm with respect to the playing surface is adjustable by sliding the collar up or down on the leg and engaging the collar at the desired height.

9. The device of claim 5 wherein the means for mounting the arm to the trampoline comprises:

a collar attached to the inner end of the arm, said collar having an aperture for receiving one of the legs of the trampoline and permitting relative rotational motion of the collar and arm about the leg; and, means for engaging the collar to the leg of the trampoline at a preselected orientation of the collar and arm about the leg so that the direct distance between the bag on the arm and the playing surface is adjustable by rotating the collar and arm about the leg and engaging the collar to the leg at the desired point.

10. The device of claim 8 wherein the collar is provided with a threaded hole and wherein the means for engaging the collar to the leg is a bolt threaded through the hole in the collar that can be tightened to impinge on the leg.

11. The device of claim 9 wherein the collar is provided with a threaded hole and wherein the means for engaging the collar to the leg is a bolt threaded through the hole in the collar that can be tightened to impinge on the leg.

12. The device of claim 10 wherein the collar has a quadrilateral cross-section and the hole on the collar is at one of the corners so that as the bolt threaded through the hole is tightened, it impinges on the leg of the trampoline and engages the leg between the end of the bolt and the two sides of the collar opposite the bolt.

13. The device of claim 11 wherein the collar has a quadrilateral cross-section and the hole on the collar is at one of the corners so that as the bolt threaded through the hole is tightened, it impinges on the leg of the trampoline and engages the leg between the end of the bolt and the two sides of the collar opposite the bolt.

14. The device of claim 5 wherein the means for resiliently mounting the bag to the arm comprises:

a spring means attached to the bag; and, a threaded member extending upwardly from the arm and over which the bottom of the spring means is secured.

15. A sports training and practice device adapted for mounting to a trampoline, the trampoline having a resilient surface acting as a playing surface on a frame supported by a plurality of legs, said device comprising:

an arm, said arm having an inner end and an outer end;

a collar attached to the inner end of the arm, said collar having a central aperture for installation over one of the legs of the trampoline and permitting relative sliding and rotational movement therebetween;

means for engaging the collar to the leg of the trampoline;

a bag, and, means for resiliently mounting the bag upright on the arm near its outer end in a position where it can be kicked by a player located on the playing surface, said resilient mounting means having means to return the bag to its original position after it is displaced by kicking.

16. The device of claim 15 wherein the collar is provided with a threaded hole and wherein the means for engaging the collar to the leg is a bolt threaded through the hole in the collar that can be tightened to impinge on the leg.

17. The device of claim 16 wherein the collar has a quadrilateral cross-section and the hole on the collar is at one of the corners so that as the bolt threaded through the hole is tightened, it impinges on the leg of the trampoline and engages the leg between the end of the bolt and the two sides of the collar opposite the bolt.

18. The device of claim 15 wherein the means for resiliently mounting the bag to the arm comprises:

a spring means attached to the bag; and, a threaded member extending upwardly from the arm and over which the bottom of the spring means is secured.

* * * * *